US007110705B2

(12) United States Patent
Harumoto

(10) Patent No.: US 7,110,705 B2
(45) Date of Patent: Sep. 19, 2006

(54) IMAGE FORMING DEVICE

(75) Inventor: Katsumi Harumoto, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/792,818

(22) Filed: Mar. 5, 2004

(65) Prior Publication Data

US 2005/0013633 A1 Jan. 20, 2005

(30) Foreign Application Priority Data

Jul. 14, 2003 (JP) ..... 2003-274327

(51) Int. Cl.
*G03G 15/08* (2006.01)

(52) U.S. Cl. ..... 399/258; 399/120; 399/262

(58) Field of Classification Search ..... 399/254, 399/255, 256, 258, 262, 119, 120, 358, 359
See application file for complete search history.

(56) References Cited

U.S. PATENT DOCUMENTS 6,104,900 A * 8/2000 Ishikawa et al. ..... 399/227
6,366,755 B1 * 4/2002 Takashima ..... 399/254
6,600,881 B1 * 7/2003 Cornelius ..... 399/12

FOREIGN PATENT DOCUMENTS

JP 2002-372828 12/2002

* cited by examiner

*Primary Examiner*—Hoang Ngo
(74) *Attorney, Agent, or Firm*—Morgan, Lewis & Bockius, LLP

(57) ABSTRACT

An image forming device that forms images by electrophotographic processes and includes a toner cartridge loading part in which three or more toner cartridges for housing toners used to form the images are loaded, wherein the toner cartridges are juxtaposed in two or more rows in a length direction or lateral direction in a toner cartridge insertion face of the toner cartridge loading part.

20 Claims, 13 Drawing Sheets

IMAGE FORMING DEVICE

BACKGROUND OF THE INVENTION

1. Field of the Invention

The present invention relates to an image forming device, and more particularly to a compact image forming device that can effectively utilize free spaces of the image forming device forming images by electrophotographic processes.

2. Description of the Related Art

In recent years, in image forming devices such as a copying machine and a printer that use electrophotographic processes, there have been widely used full-color image forming devices that form images by use of the four colors of yellow, magenta, cyan, and black.

In the full-color image forming devices, conventionally, an arrangement method that arranges four toner cartridges respectively housing the toners of the four colors in a row vertically or horizontally have been in the mainstream (Patent Reference 1).

The arrangement method is preferred in the point of trim appearance.

[Patent Reference 1] Japanese Published Unexamined Patent Application No. 2002-372828

However, arranging four toner cartridges according to the arrangement method requires a considerable space along the length or lateral direction, increasing the height or width of the full-color image forming devices.

Particularly, in recent years, the problem has been conspicuous because of the trend to use large toner cartridges to extend their life.

SUMMARY OF THE INVENTION

The present invention has been made to solve the problem and provides a compact image forming device that can effectively utilize free spaces.

An image forming device intended to solve the problems forms images by electrophotographic processes, and includes a toner cartridge loading part in which three or more toner cartridges for housing toners used to form the images are loaded. The toner cartridges are juxtaposed in two or more rows in a length direction or lateral direction in a toner cartridge insertion face of the toner cartridge loading part. Degrees of the juxtaposition of the toner cartridges in two or more rows in the length or lateral direction include, in addition to perfect alignment of the toner cartridges in the vertical or horizontal direction, some misalignment of the toner cartridges, such as the state in which a vertical or horizontal line passing through the center of a toner cartridge overlaps another toner cartridge.

BRIEF DESCRIPTION OF THE DRAWINGS

Preferred embodiments of the present invention will be described in detail based on the following figures, wherein.

DESCRIPTION OF THE PREFERRED EMBODIMENTS

1. First Embodiment

Hereinafter, a laser printer as an example of an image forming device of the present invention, and a wireless communication system in the laser printer are described with reference to the drawings.

(Configuration of Laser Printer)

Figure 1:
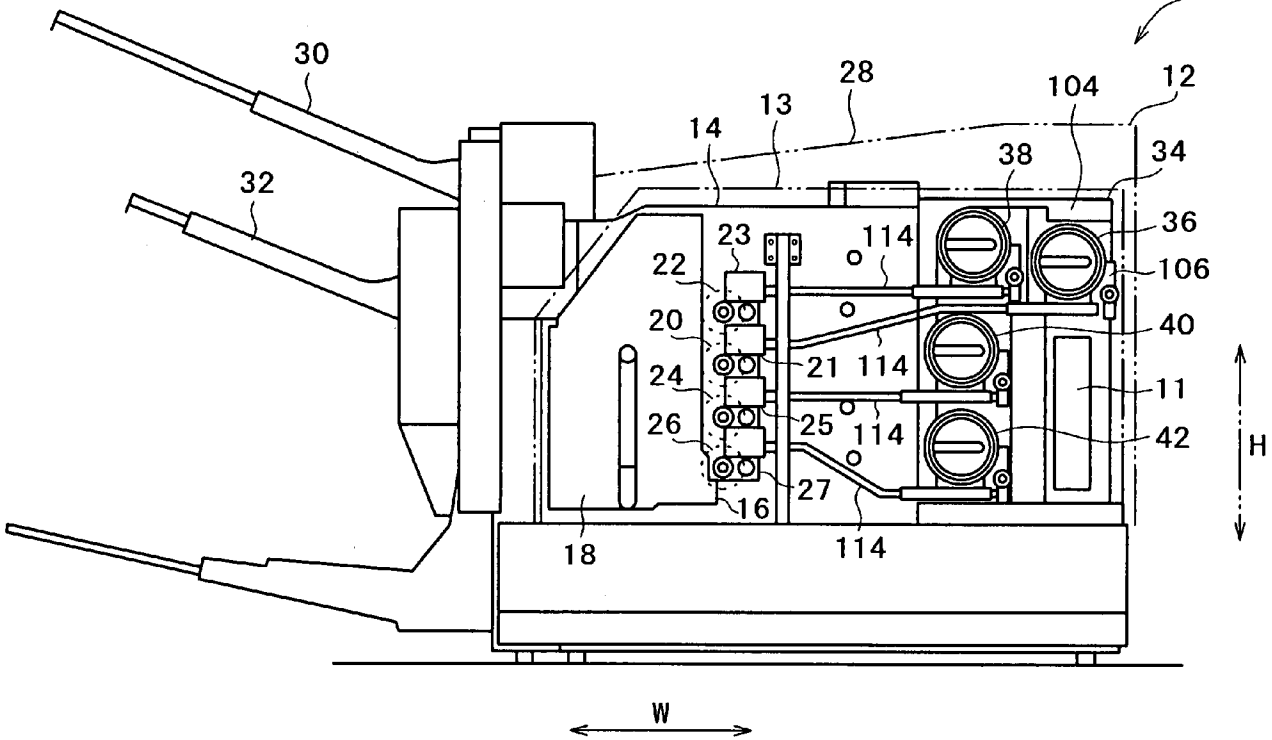
FIG. 1 is a front view showing the overall configuration of a laser printer according to a first embodiment.

FIG. 1 shows the overall configuration of laser printer 10 according to a first embodiment.

The laser printer 10 forms toner images on the basis of image information inputted from an external device by known electrophotographic processes, and transfers the formed toner images to a recording sheet, and fixes them to form an image. The electrophotographic processes refer to a series of processes for recording an image on a recording material, including the electrification of an electrophotographic photosensitive member, the formation of electrostatic latent images by laser exposure, the development of the electrostatic latent images by toners and the subsequent transfer of toner images formed on the electrophotographic photosensitive member to the recording member, and the heating and fixing of the toner images. The laser printer 10 forms a color image by use of the toners of four colors of magenta (M), yellow (Y), black (K), and cyan (C).

As shown in FIG. 1, the laser printer 10 includes a housing 12 constituting the outer edge of the device, and a mainframe 14, provided within the housing 12, that supports components making up the device.

The mainframe 14 has process units 16 disposed at one end (the left end in FIG. 1) along the width direction (the direction of the arrow W) of the device. The process unit 16 is provided with a slide frame 18 slidably supported along the depth direction of the device by mainframe 14. The slide frame 18 is equipped with specified process parts (omitted in the drawing) such as an intermediate transfer belt, a transferring unit, a cleaning unit, and the like. With this construction, during maintenance, by removing the process unit 16 from the mainframe 14, the process parts mounted in the slide frame 18 can be easily replaced and inspected.

In the mainframe 14, four photosensitive drums 20, 22, 24, and 26 are supported adjacent to the process units 16, and four developers 21, 23, 25, 27 are disposed in contact with the photosensitive drums 20, 22, 24, and 26, respectively. The four developers 21, 23, 25, 27 are supplied with a magenta (M) toner, a yellow (Y) toner, a black (K) toner, and a cyan (C) toner, respectively. The toners are adhered to electrostatic latent images formed on the outer circumferential face (the image carrying face) of the photosensitive drum 20, 22, 24, and 26 to develop the electrostatic latent images into toner images. Hereinafter, the magenta (M) toner, yellow (Y) toner, black (K) toner, and cyan (C) toner are simply referred to as an M toner, a Y toner, a K toner, and a C toner, respectively.

The toner images respectively formed on the four photosensitive drums 20, 22, 24, and 26 are transferred to and superimposed on an intermediate transfer belt disposed on the side of the process units 16 and formed into full-color toner images. The full-color toner images are transferred from an intermediate transfer belt to a recording material such as a recording sheet, and then heated and fixed before being recorded on the recording material.

The recording material on which the toner images are recorded is discharged to discharge trays 30 and 32 that are on a discharge tray part 28 formed on the upper face of the housing 12 or mounted at the side of the housing 12 so that they extend sideways.

The laser printer 10 may be configured so that it forms a monochrome toner image by only the K toner, and transfers and fixes it to a recording material to form a monochrome image.

Figure 2:
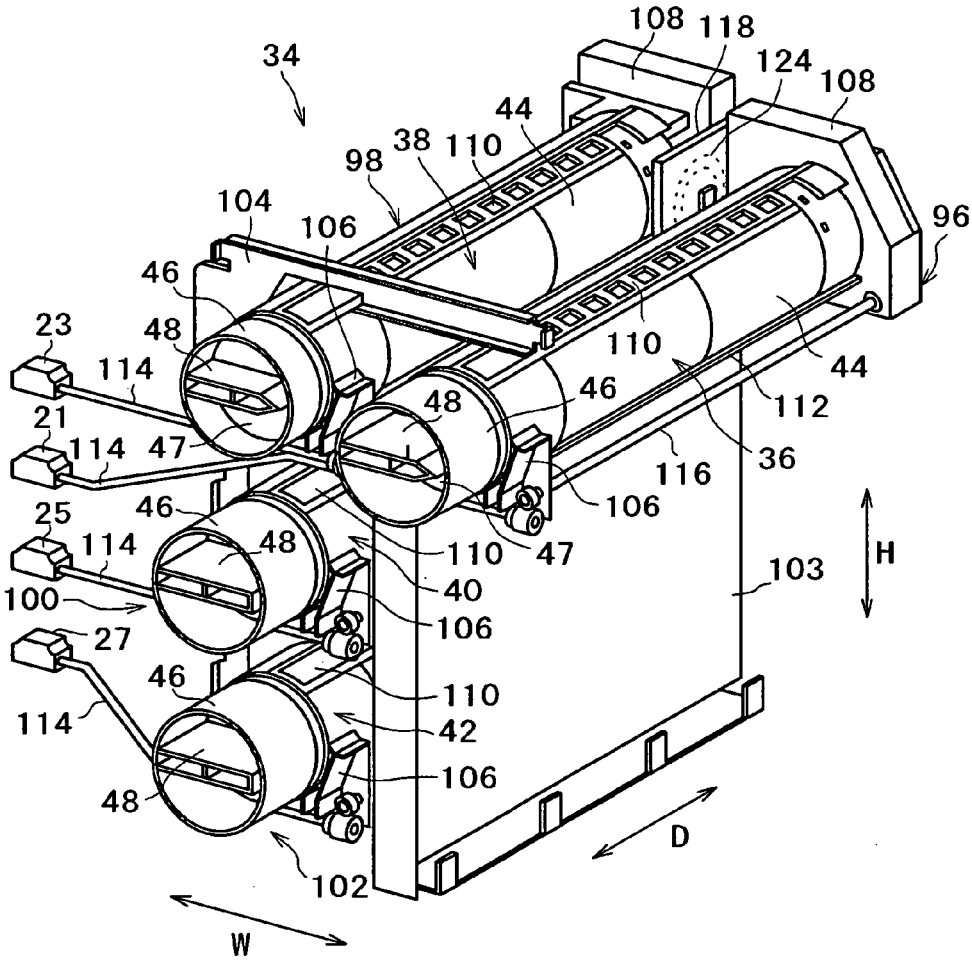
FIG. 2 is a perspective view showing the state in which toner cartridges are loaded in a cartridge holder included in a laser printer shown in FIG. 1.

The laser printer 10 is provided with a cartridge holder 34 adjacently to the mainframe 14 along the width direction. The cartridge holder 34 corresponds to a toner cartridge loading part in the image forming device of the present invention. As shown in FIG. 2, in the cartridge holder 34, four toner cartridge 36, 38, 40, and 42 formed in substantially cylindrical shapes respectively are detachably loaded. The toner cartridges 36, 38, 40, and 42 are filled with an M toner, Y toner, K toner, and C toner, respectively.

As shown in FIG. 1, the housing 12 is provided at the side of one side (in front of paper of FIG. 1) thereof with a maintenance-use open/close door 13 in opposed relation to the process units 16 and the cartridge holder 34. With this construction, by opening and closing the open/close door 13 and exposing the process units 16 and the cartridge holder 34 to the outside, the user can remove the process units 16 from the mainframe 14 and load and unload the toner cartridges 36, 38, 40, and 42 in and from the cartridge holder 34.

As shown in FIG. 2, in the cartridge holder 34, the loading/unloading parts 96, 98, 100, and 102 in which the toner cartridge 36, 38, 40, and 42 are detachably loaded are provided in two rows along the height direction H (the direction of the arrow H) of the device, that is, the vertical direction. Three loading/unloading parts 98, 100, and 102 are provided in a first row of the two rows nearer to the developers 21, 23, 25, and 27, and one loading/unloading part 96 is provided in a second row farther from the developers 21, 23, 25, and 27.

Therefore, as shown in FIGS. 1 and 2, the four toner cartridges 36, 38, 40, and 42 loaded in the cartridge holder 34 are arrayed in the shape of an inverted L character when viewed from the outside of the axial direction. Accordingly, the toner cartridges 36, 38, 40, and 42 are housed more compactly along the height direction H of the device than when they are arrayed linearly along the height direction H.

An electronic circuit device 11 controlling the laser beam printer 10 is housed in a space surrounded by the loading/unloading parts 96, 98, 100, and 102 arrayed in the shape of the inversed L character, that is, a space surrounded by the toner cartridges 36, 38, 40, and 42. By housing the electronic circuit device 11 in the space, it is protected effectively from toner clouds occurring in the developing parts 21, 23, 25, and 27.

Since the laser beam printer 10 usually performs monochrome printing far more frequently than full color printing, it is conceivable that the consumption of the K toner is the largest. Therefore, if the toner cartridges are arranged so that, in the second row, the toner cartridge 40 housing the K toner is placed in place of the cartridge 36 housing the M toner, the cartridge 36 is placed in the middle of the first row, and the toner cartridge 40 is constructed to be larger in size than the toner cartridges 36, 38, and 42, preferably, without increasing the dimension of the laser printer 10, the replacement cycles of the toner cartridges 36, 38, 40, and 42 would be prolonged.

Instead of the loading/unloading parts 96, 98, 100, and 102 being disposed so that the toner cartridges 36, 38, 40, and 42 are loaded with the array as shown in FIGS. 1 and 2, if the toner cartridge 36 is disposed at a height substantially identical with a toner cartridge in the lowest column, of the toner cartridges 38, 40, and 42 arranged in the first row, the toner cartridges 36, 38, 40, and 42 are arrayed in the shape of the L character when loaded in the loading/unloading part 96, 98, 100, and 102. Such an arrangement is preferable in the case where a circuit generating a large amount of heat such as a power circuit is mounted as the electronic circuit device 11. Since the electronic circuit device 11 is housed in the space surrounded by the toner cartridges 36, 38, 40, and 42 arrayed in the shape of the L character, none of the toner cartridges 36, 38, 40, and 42 exists above the electronic circuit device 11. Therefore, since heat generated in the electronic circuit device 11 is radiated upward and the heat does not reach any of the toner cartridges 36, 38, 40, and 42, there will occur no toner blocking that toners coagulate within the toner cartridges.

Moreover, when it is necessary to make the height of the cartridge holder 34 lower, the loading/unloading parts 96, 98, 100, and 102 may be disposed so that the toner cartridges 36, 38, 40, and 42 are arrayed in the first and second rows, two in each row. In this case, the electronic circuit device 11 may be disposed above or below the loading/unloading parts 96, 98, 100, and 102.

Furthermore, in the case where the developers 21, 23, 25, 27 are arrayed horizontally, the loading/unloading parts 96, 98, 100, and 102 may be disposed so that the three toner cartridges 38, 40, and 42 are arrayed in the horizontal direction below the developers 21, 23, 25, and 27, and further one toner cartridge 36 is arrayed below the three toner cartridges. In this case, the toner cartridge 36 may be disposed below a toner cartridge that is positioned in the left end or the right end of the toner cartridge 38, 40, and 42. Also in the case where the toner cartridges 36, 38, 40, and 42 are thus arrayed, by housing the electronic circuit device 11 in the space formed below the toner cartridges 36, 38, 40, and 42, the electronic circuit device 11 can be protected from the toner cloud occurring in the developers 21, 23, 25, and 27.

Figure 3:
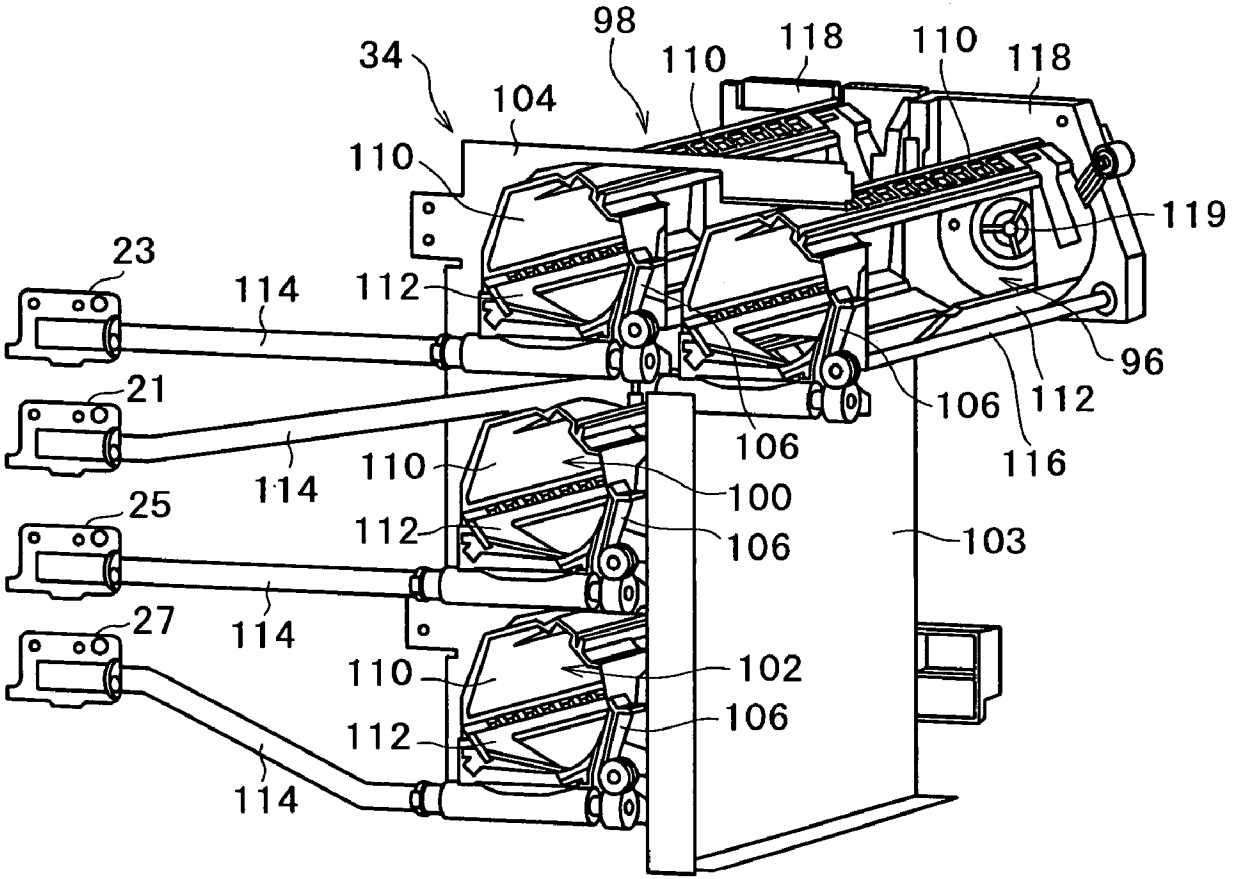
FIG. 3 is a perspective view showing the front of the cartridge holder shown in FIG. 2 from which the toner cartridges are removed.
Figure 4:
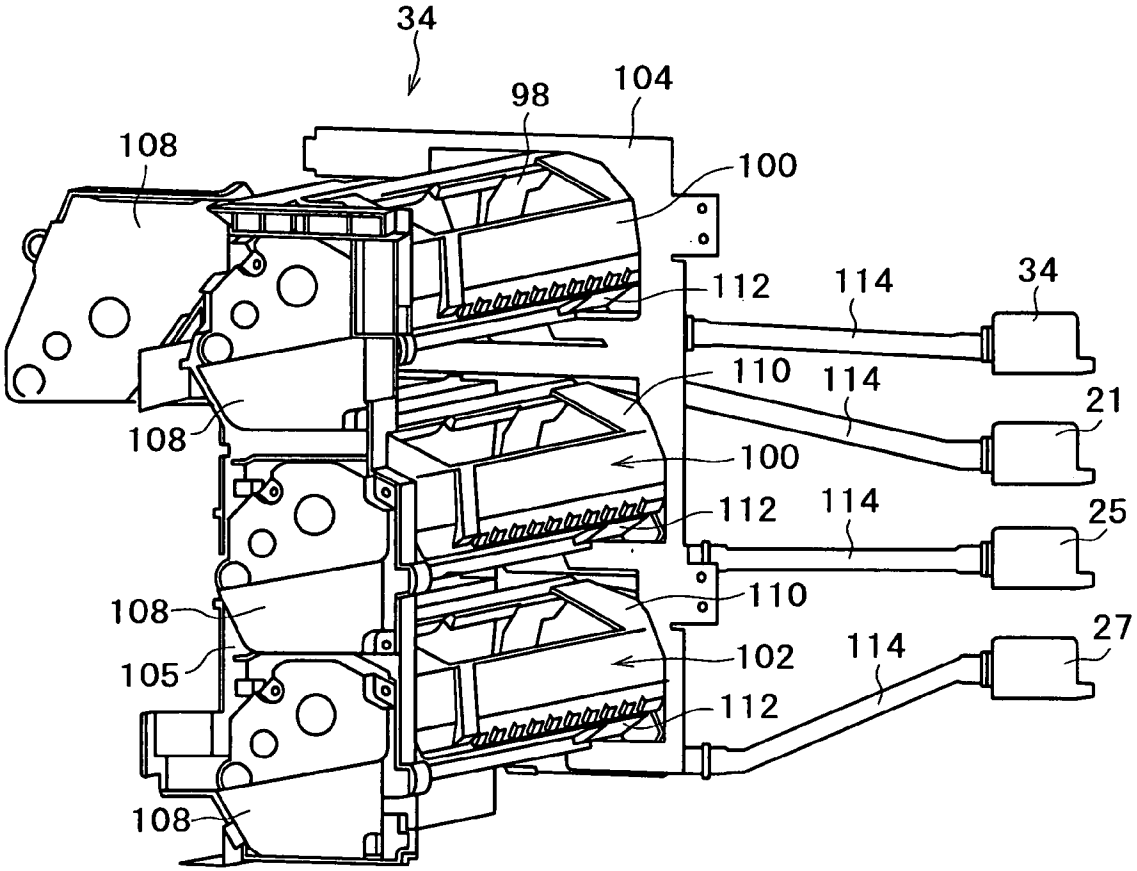
FIG. 4 is a perspective view showing the back of the cartridge holder shown in FIG. 3.

The loading/unloading parts 96, 98, 100, and 102, as shown in FIGS. 2 to 4, are formed to be identical with one another in size along the axial direction, the front end is supported by a front support plate 104 extending in the shape of the inverted L character so that it surrounds the toner cartridges 36, 38, 40, and 42 at the front end of the cartridge holder 34, and the back end is supported by a back support plate 105 provided at the back of the cartridge holder 34 so as to face the front support plate 104.

The front support plate 104 and the back support plate 105 are connected by a connection plate 103 extending in the vertical direction. The connection plate 103 also separates the cartridge holder 34 from the space housing the electronic circuit device 11.

The loading/unloading parts 96, 100, and 102 are arranged so as to be identical in position along the axial direction, that is, the depth direction D of the laser printer 10. Only the loading/unloading part 98 is forward projectingly arranged with respect to the loading/unloading parts 96, 100, and 102 along the depth direction D of the laser printer 10. Such an arrangement of the loading/unloading parts 96, 98, 100, and 102 prevents interference between toner feeding tubes 114 provided in the loading/unloading parts 98 and 96.

As shown in FIGS. 2 to 4, any of the loading/unloading parts 96, 98, 100, and 102 includes a support bracket 106, a drive plate 108 arranged so as to face the support bracket 106, and two guide members 110 and 112 bridged between the drive plate 108 and support bracket 106 along the depth direction D. The loading/unloading parts 96, 98, 100, and 102 are supported by the front support plate 104 in the support bracket 106, and supported by the back support plate 105 in the drive plate 108. The toner cartridges 36, 38, 40, and 42 are guided to move linearly along the depth direction by the guide members 100 and 112 when inserted in and removed from the cartridge holder 34.

Figure 5:
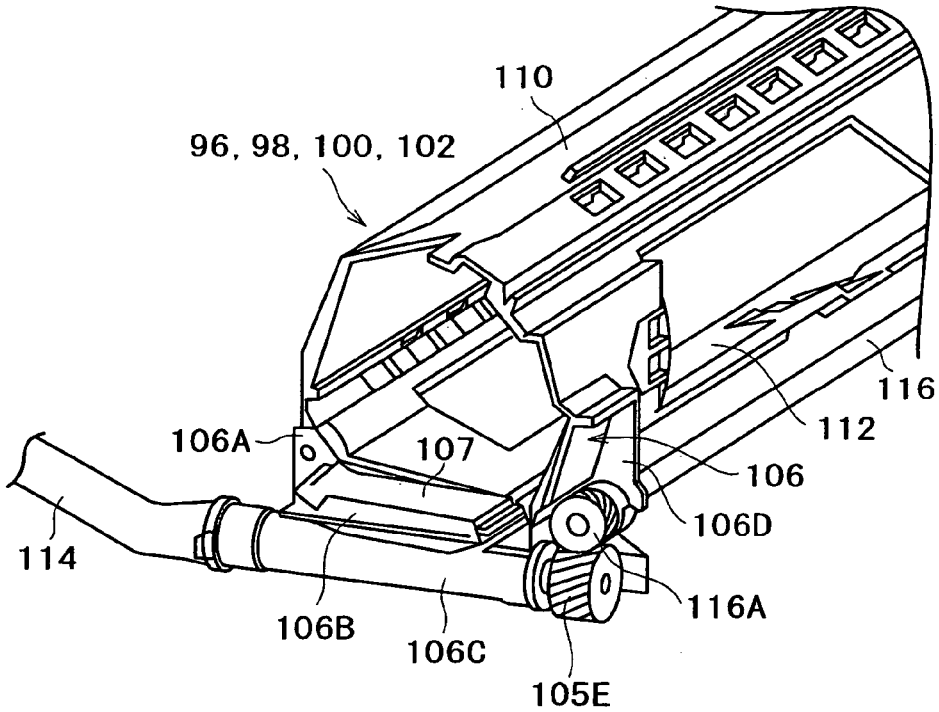
FIG. 5 is a partially enlarged view showing the construction of a loading/unloading part, in the vicinity of a support bracket, included in the cartridge holder.
Figure 6A:
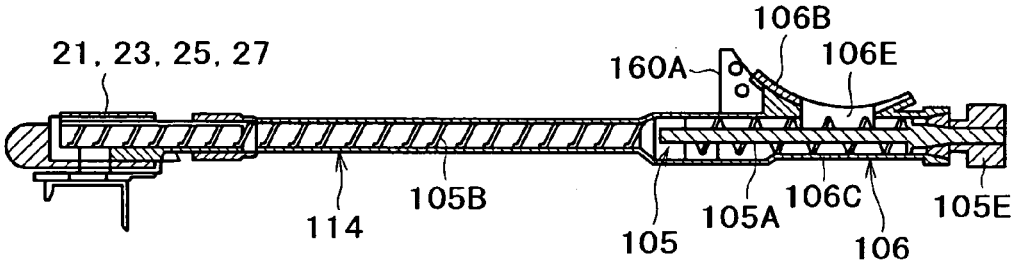
FIGS. 6A and 6B are sectional views showing the construction of a support bracket included in the loading/unloading part, a toner feeding pipe connecting the support bracket and a developer, and an auger disposed within the toner feeding pipe.
Figure 6B:
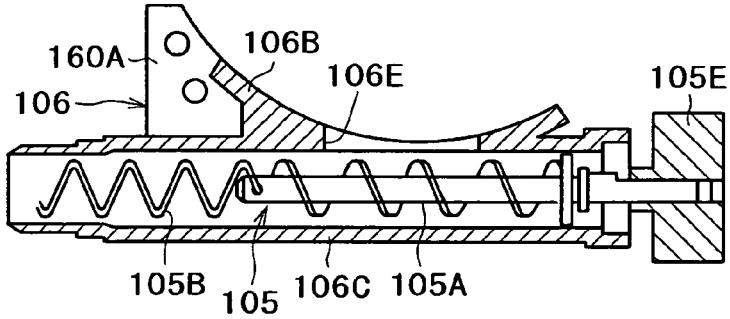

The support bracket 106, as shown in FIGS. 5 and 6, includes: a fixing part 106A fixed to the front support plate 104; a shutter receiving member 106B that adjoins the fixing part 106A and extends to right angles to the axis line of the loading/unloading parts 96, 98, 100, and 102; a cylindrical toner guiding part 106 C that adjoins the lower portion of the shutter receiving member 106B and extends to right angles to the axis line of the loading/unloading parts 96, 98, 100, and 102; and a bearing plate 106D that is provided on the opposite side of the fixing part 106A with the shutter receiving member 106B interposed therebetween and supports a torque transfer axis 116 described later. The shutter receiving member 106B is of partial cylindrical shape with an upward concave indention, and an engaging shutter 107 slides on the upper face thereof. The shutter receiving member 106B is provided with an opening 106E that communicates with the toner guiding part 106C. The engaging shutter 107 opens and closes in engagement with a shutter member 56 (described later) of the toner cartridges 36, 38, 40, and 42.

The drive plate 108 is formed in the shape of thick plate as shown in FIG. 4, and supported so that the thickness direction coincides with the depth direction of the device. In the drive plate 108, a driving coupling plate 109 for engaging with and rotating a driven coupling plate 52 (see FIG. 6) of the toner cartridges 36, 38, 40, and 42 is rotably provided on the surface facing the bottom of the toner cartridges 36, 38, 40, and 42. The drive coupling plate 109 is formed in a shape symmetrical with the driven coupling plate 52. Each of the drive plates 108 includes a drive motor (not shown), which rotates during the operation of developers 21, 23, 25, and 27 and rotates the drive coupling plate 109. The drive plate 108 is further provided with the torque transfer axis 116. A spiral gear 116A is fitted at the tip of the torque transfer axis 116 on the side of the support bracket 106.

Each of the loading/unloading parts 96, 98, 100, and 102 is further provided with the toner feeding tube 114 for feeding a toner to the developers 21, 23, 25, and 27, as shown in FIGS. 1 to 4. The toner feeding tube 114 is constructed from a semitransparent or transparent flexible tube. One end of the toner feeding tube 114 is connected to the toner guiding part 106C in the support bracket 106 and the other end is connected to the developers 21, 23, 25, and 27.

As shown in FIG. 6, an auger 105 is disposed within the toner feeding tube 114. The auger 105, housed within the toner guiding part 106C as shown in FIG. 6, includes an extruding auger 105A supported by the toner guiding part 106C in the base of the auger 105, and a spiral auger 105B that is fixed at the edge of the extruding auger 105A and rotates within the toner feeding tube 114. The extruding auger 105A includes a spiral blade 105D, and an rotation axis 105C provided at the center of the blade 105D. A helical gear 105E is fixed to the base of the rotation axis 105C. The helical gear 105E meshes with a helical gear 116A of the torque transfer axis 116, and transfers the rotation of the torque transfer axis 116 to the rotation axis 105C of the auger 105. With this construction, the torque of the drive motor within the drive plate 108 is transferred to the rotation axis 105C through the torque transfer axis 116 and the auger 105 rotates.

Figure 7A:
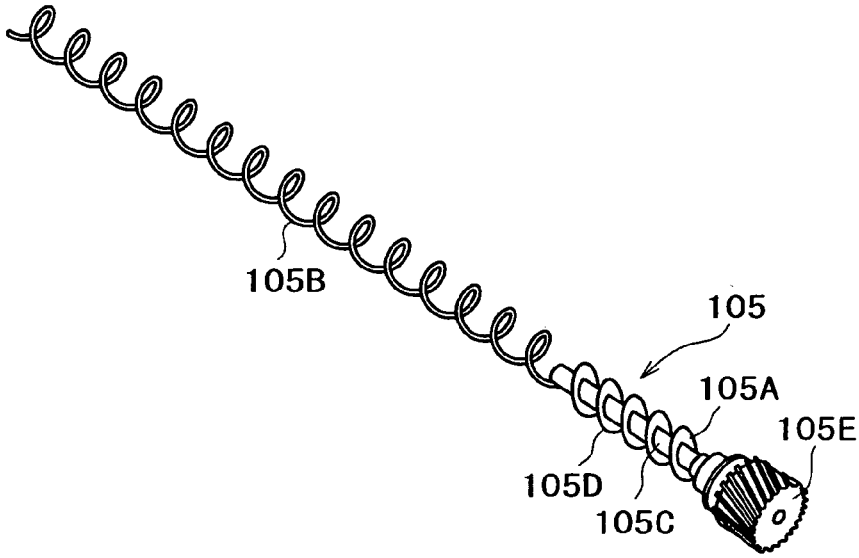
FIGS. 7A and 7B are perspective views showing details of the construction of the auger shown in FIG. 6.
Figure 7B:
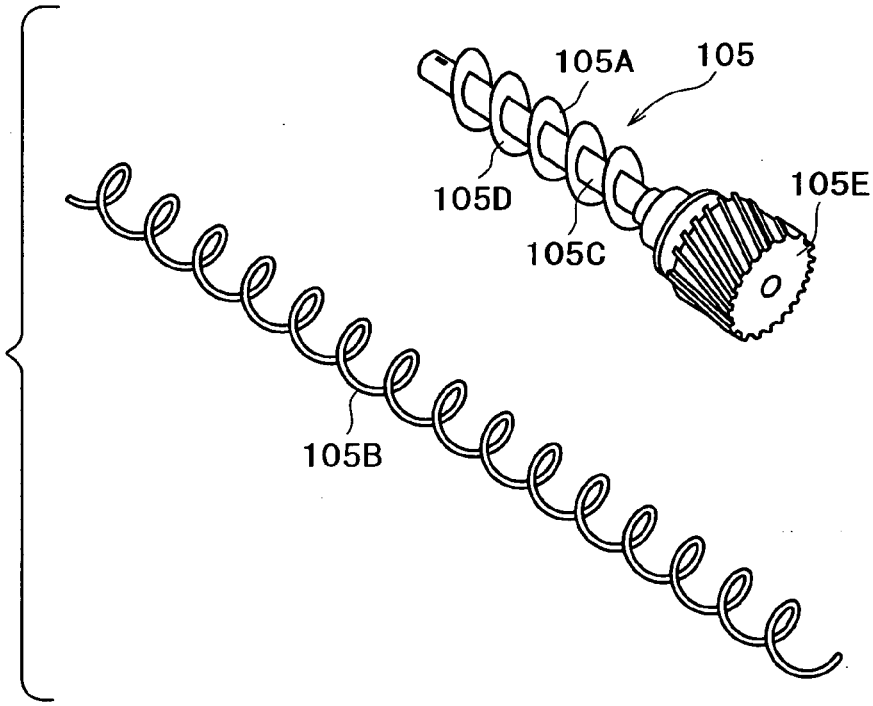

The spiral auger 105B, which corresponds to the auger in the image forming device of the present invention, is constructed of a thin metal plate about 1 mm wide and 0.2 to 0.3 mm thick spirally wound as shown in FIGS. 6 and 7. The outside diameter of the spiral auger 105B is formed to be 1 to 2 mm smaller than the inside diameter of the toner feeding tube 114.

Since the toner feeding tube 114 is a semitransparent or transparent flexible tube as described previously, restrictions on the arrangement between the loading/unloading parts 96, 98, 100, and 102 and the developers 21, 23, 25, and 27 are relaxed. Since one tube suffices to form the toner feeding tube 114, it does not need to be constructed from plural members. Further, it can be easily visually determined from the outside whether toners remain inside after cleaning.

The toner feeding pipe 114 is arranged so that a gradient formed by the start point and the end point of the toner feeding pipe 114 is within ±20 degrees with respect to the horizontal direction. Therefore, the following problems will not occur that would occur when the upward gradient or downward gradient of the toner feeding pipe 114 is excessively large: coagulated toners increase toner density and increase the amount of toners discharged, and the amount of toners transported is variable and cannot be controlled to be constant. As a result, toners can be stably transported with a predetermined transport amount. Therefore, it is unnecessary to control the rotation of the auger 105 for each of the loading/unloading parts 96, 98, 100, and 102.

Further, as described previously, since the spiral auger 105B of the auger 105 is constructed of a strip-like thin metal plate spirally wound, even if the toner feeding pipe 114 is bent, the friction between the interior wall of the toner feeding pipe 114 and the spiral auger 105B does not become so strong. It does not occur that the friction between the toner feeding pipe 114 and the spiral auger 105B yields toner lumps, resulting in reduced image quality.

Moreover, since the difference between the inside diameter of the toner feeding pipe 114 and the outside diameter of the spiral auger 105B is 1 to 2 mm, the generation of toner lumps is prevented more effectively.

Figure 8:
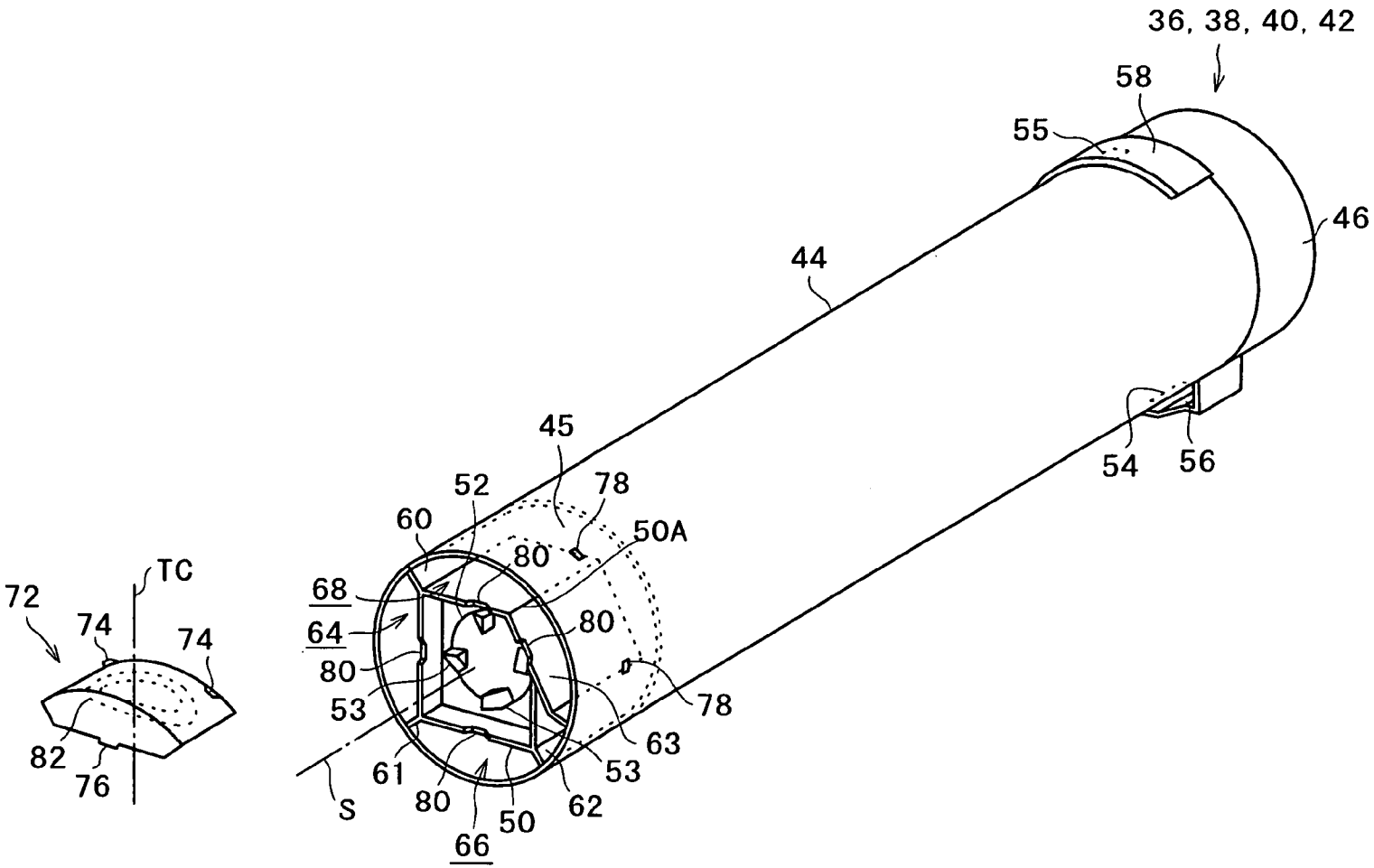
FIG. 8 is a perspective view showing details of the construction of a toner cartridge loaded in the cartridge holder.

The toner cartridges 36, 38, 40, and 42 include a cylindrical closed-end cartridge body 44 as shown in FIG. 8. The opening of the cartridge body 44 is fitted into a cylindrical cap part 46 as shown in FIGS. 8 and 2, and covered. The cap part 46 has an outside diameter substantially identical with that of the cartridge body 44, and is of closed-end cylindrical shape having a bottom part 47. Inside the cap part 46 is formed a handle part 48 of plate shape integrated with the bottom part 47. As shown in FIG. 2, although the cap parts 46 of the toner cartridges 36, 40, and 42 are all identical in size in the thickness direction, the cap part 46 of the toner cartridge 38 is smaller in size in the thickness direction than the cap parts 46 of the toner cartridges 36, 40, and 42. As described previously, the loading/unloading part 98 in which the toner cartridge 38 is loaded is disposed forwardly projectingly in comparison with the other loading/unloading parts 96, 100, and 102. However, since the cap part 46 of the toner cartridge 38 is small in size in the thickness direction, when the toner cartridges 36, 38, 40, and 42 are loaded in the loading/unloading parts 96, 98, 100, and 102, the ends of the cap parts 46 of the toner cartridges 36, 38, 40, and 42 are flush with one another. Thereby, it is prevented that the toner cartridges 36, 38, 40, and 42 are loaded in the loading/unloading parts 96, 98, 100, and 102 without being sufficiently deeply pushed in.

On the other hand, within the cartridge body 44, a screw feeder (not shown) for toner transport that is formed on the screw axis is coaxially disposed. The screw feeder is coupled to the driven coupling plate 52 and rotates integrally with the driven coupling plate 52.

In the vicinity of the opening in the circumferential wall of cartridge body 44, as shown in FIG. 8, a toner supply port 54 and a toner filling port 55 are open. In the outer periphery of the toner supply port 54, a slidable shutter member 56 is disposed along the circumference direction. The shutter member 56 is slidably formed between the closing position that closes the toner supply port 54 and the opening position that opens the toner supply port 54, and is energized to be always held in the closing position by an energizing member (not shown) such as a coil spring. With this construction, the shutter member 56 is held in the closing position when the toner cartridges 36, 38, 40, and 42 are not loaded in the cartridge holder 34. The toner filling port 55 is closed by a cap member 58 fixed to the outer circumferential face of the cartridge body 44.

As shown in FIG. 8, an inner circumferential wall 50 is provided at the center of the bottom of the cartridge body 44. Inside the inner circumferential wall 50, a cylindrical driven coupling plate 52 is rotatably provided around the axis line S of the cartridge body 44. The driven coupling plate 52 has plural engaging claws 53 formed integrally therewith along the circumference direction. The driven coupling plate 52 is engaged with the drive coupling plate 109 by the engaging claws 53 and rotates.

Figure 10:
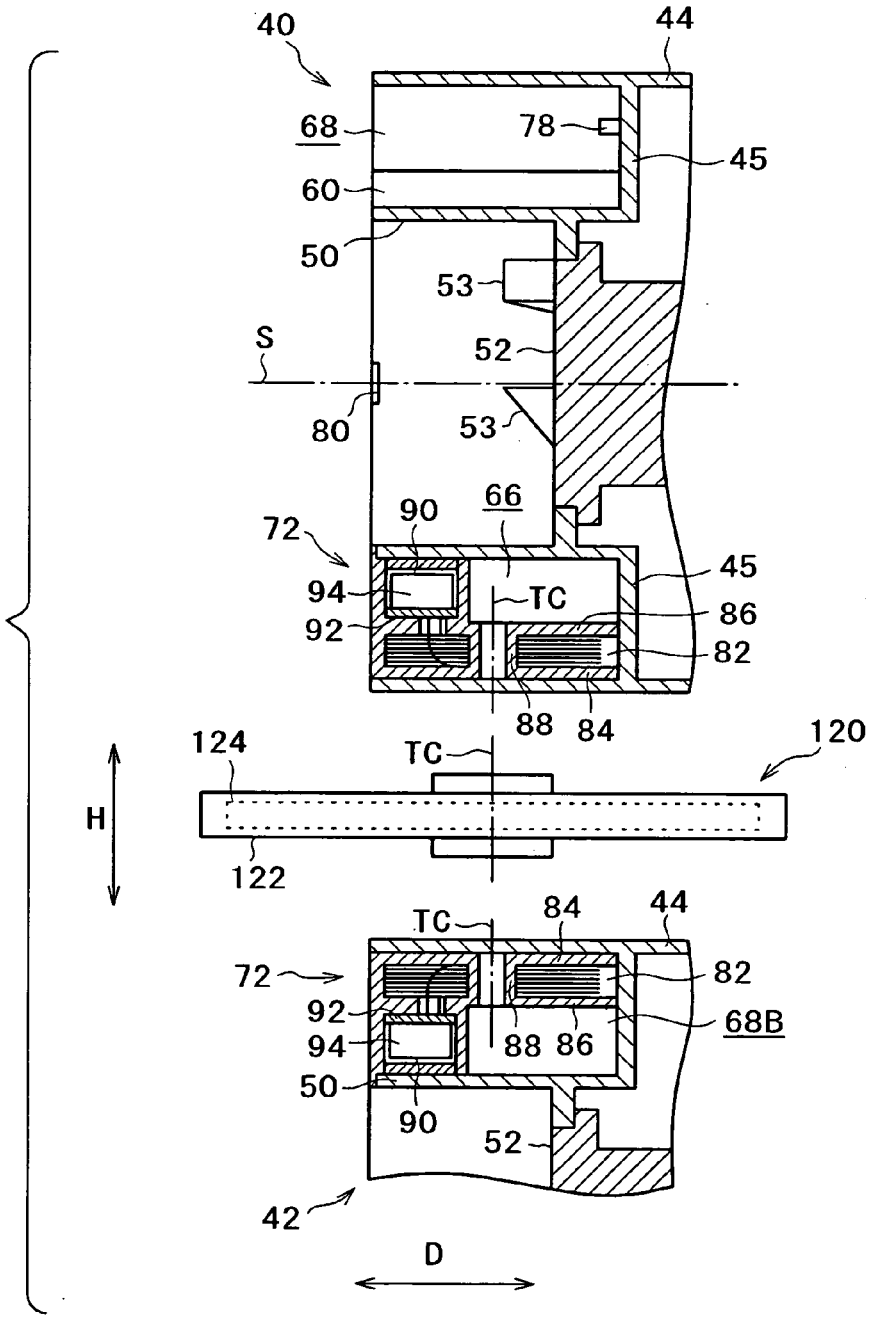
FIG. 10 is a sectional view showing the configuration of the base of the toner cartridge.

Moreover, between the inside wall of the inner circumferential wall 50 and the cartridge body 44, four partitioning plates 60, 61, 62, and 63 of rib shape are formed along the radius direction. The partitioning plates 60, 61, 62, and 63 partition into small spaces a ring-shaped space formed between the inside wall and the inner circumferential wall 50 of the cartridge body 44 along the circumference direction. These small spaces are open at the tip of the cartridge body 44, and closed at the rear end thereof by a bottom plate 45 of the cartridge body 44 as shown in FIG. 10.

Figure 9:
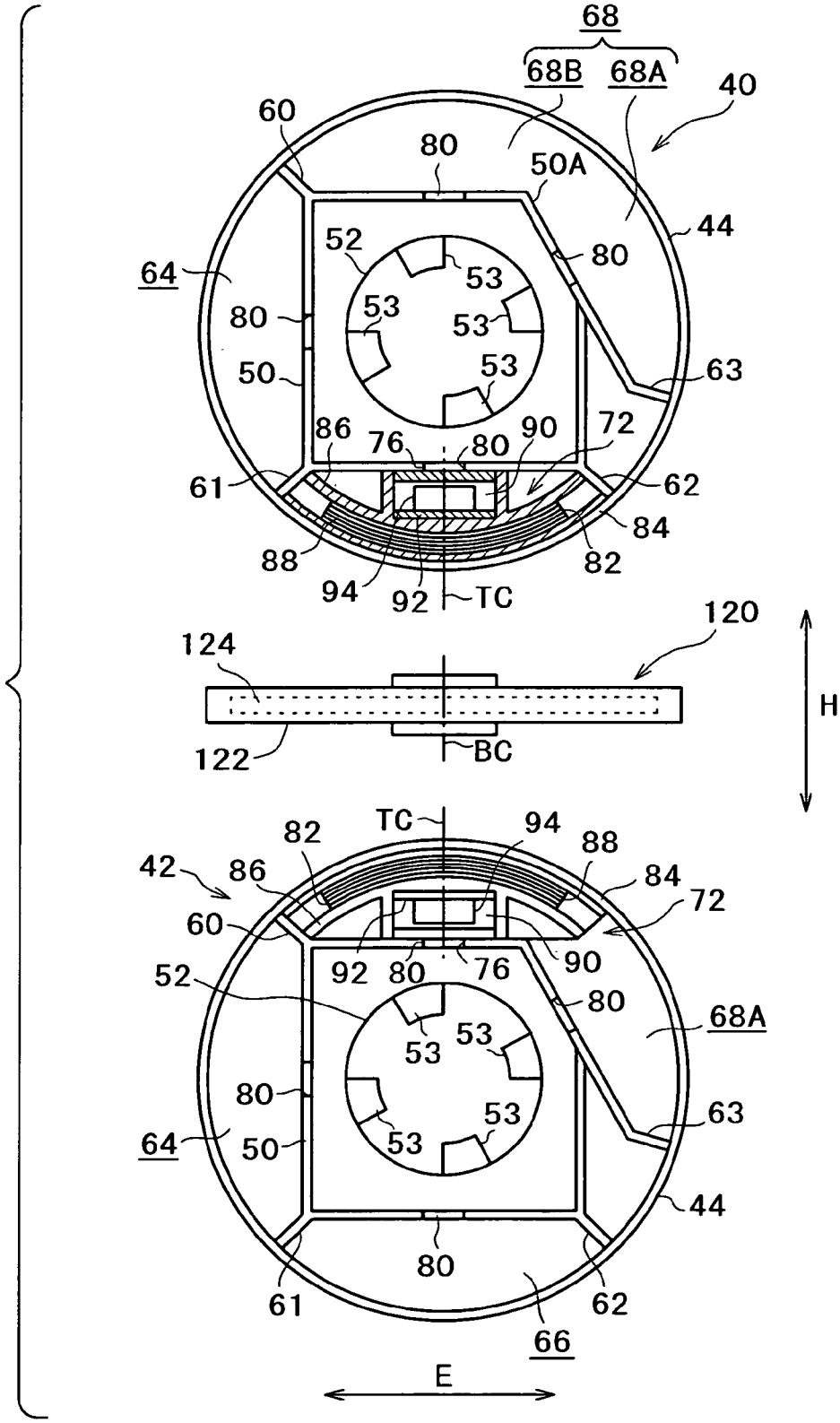
FIG. 9 is a plane view showing the construction of the base of the toner cartridge.

Within the cartridge body 44, as shown in FIG. 9, by the partitioning plates 60 and 61, and partitioning plates 61 and 62, storage chambers 64 and 66 for storing one wireless communication tag 72 described later are respectively formed. A small space between the partitioning plates 60 and 63 is also formed as a storage chamber 68 for storing one wireless communication tag 72. However, the storage chamber 68, as shown in FIG. 9, is functionally partitioned into storage parts 68A and 68B in the vicinity of the edge part 50A of the inner circumferential wall 50. In the storage chamber 68, the wireless communication tag 72 can be selectively stored in one of the two storage parts 68A and 68B. Accordingly, one wireless communication tag 72 is selectively stored in the storage chamber 64, the storage chamber 66, and one of the two storage parts 68A and 68B in the storage chamber 68, and loading positions change along the circumference direction according to the selected storage chambers 64 and 66, and the storage parts 68A and 68B.

As shown in FIG. 9, the sectional shape of the wireless communication tag 72 is a substantially sector shape adapted for the storage chambers 64 and 66 when viewed from the axis direction. The wireless communication tag 72 is housed and held in the storage chambers 64 and 66, and one of the two storage parts 68A and 68B in the storage chamber 68 by being fitted in the storage chamber 64, the storage chamber 66, and one of the two storage parts 68A and 68B in the storage chamber 68. In the wireless communication tag 72, one pair of hook claws 74 protruding to the outer circumference thereof are formed in the edge thereof on the side of insertion on the outer circumferential face. Moreover, an engaging protrusion 76 protruding to the axis core S is formed in the end at the entrance side. On the other hand, in the circumferential wall of the cartridge body 44, hook holes 78 corresponding to the hook claws 74 in the wireless communication tag 72 are formed for each of the storage chambers 64 and 66, and the storage parts 68A and 68B, and in the rear end of the inner circumferential wall 50, an engaging concave part 80 corresponding to the engaging protrusion 76 in the wireless communication tag 72 is formed for each of the storage chambers 64 and 66 and the storage parts 68A and 68B.

Therefore, if the wireless communication tag 72 is fitted in one of the storage chambers 64 and 66 and the storage parts 68A and 68B, the outer circumferential face thereof is brought into close contact with the inner circumferential face of the cartridge body 44, pairs of hook claws 74 are respectively inserted in pairs of hook holes 78, and engaging protrusions 76 are engaged with the engaging concave parts 80. Thereby, the wireless communication tag 72 is firmly fixed along the axis direction, and the engaging protrusions 76 are engaged with the engaging concave parts 80, so that the occurrence of wobble along the circumference direction is prevented without fail. The engaging claws 74 inserted in the engaging holes 78 are not disengaged from the engaging holes 78 unless the wireless communication tag 72 itself is elastically deformed toward the inner circumference. Therefore, the wireless communication tag 72 fitted in one of the storage chambers 64 and 66 and the storage parts 68A and 68B cannot be easily removed from the cartridge body 44 without using a special jig or the like.

As shown in FIGS. 9 and 10, within the wireless communication tag 72, a tag antenna 82 with a conductive wire such as a copper wire wound in coils is provided. The tag antenna 82 is provided so that the coil axis TC, which is the winding center of the conductive wire, becomes parallel with the thickness direction of the wireless communication tag 72, and the coil face along the direction square to the axis is curved along the outer circumferential face of the wireless communication tag 72. Specifically, the wireless communication tag 72, as shown in FIGS. 5 and 6, is provided with an outer wall 84 and an inner wall 86 that are curved so as to be parallel with each other, and a winding core 88 couples between the outer wall 84 and the inner wall 86. The conductive wire is wound at the outer circumference side of the winding core 88, whereby the flat tag antenna 82 along the axis direction is curved along the outer circumferential face of the wireless communication tag 72.

The wireless communication tag 72 is provided with an isolated chamber 90 tightly sealed from the outside on the side of the inner circumference of the tag antenna 82. The isolated chamber 90 houses a circuit board 92 on which an IC chip 94 is loaded, a control circuit of the wireless communication tag 72 being integrated as one chip. The integrated circuit chip 94 is electrically connected to the tag antenna 82 through the circuit board and the like.

Figure 11:
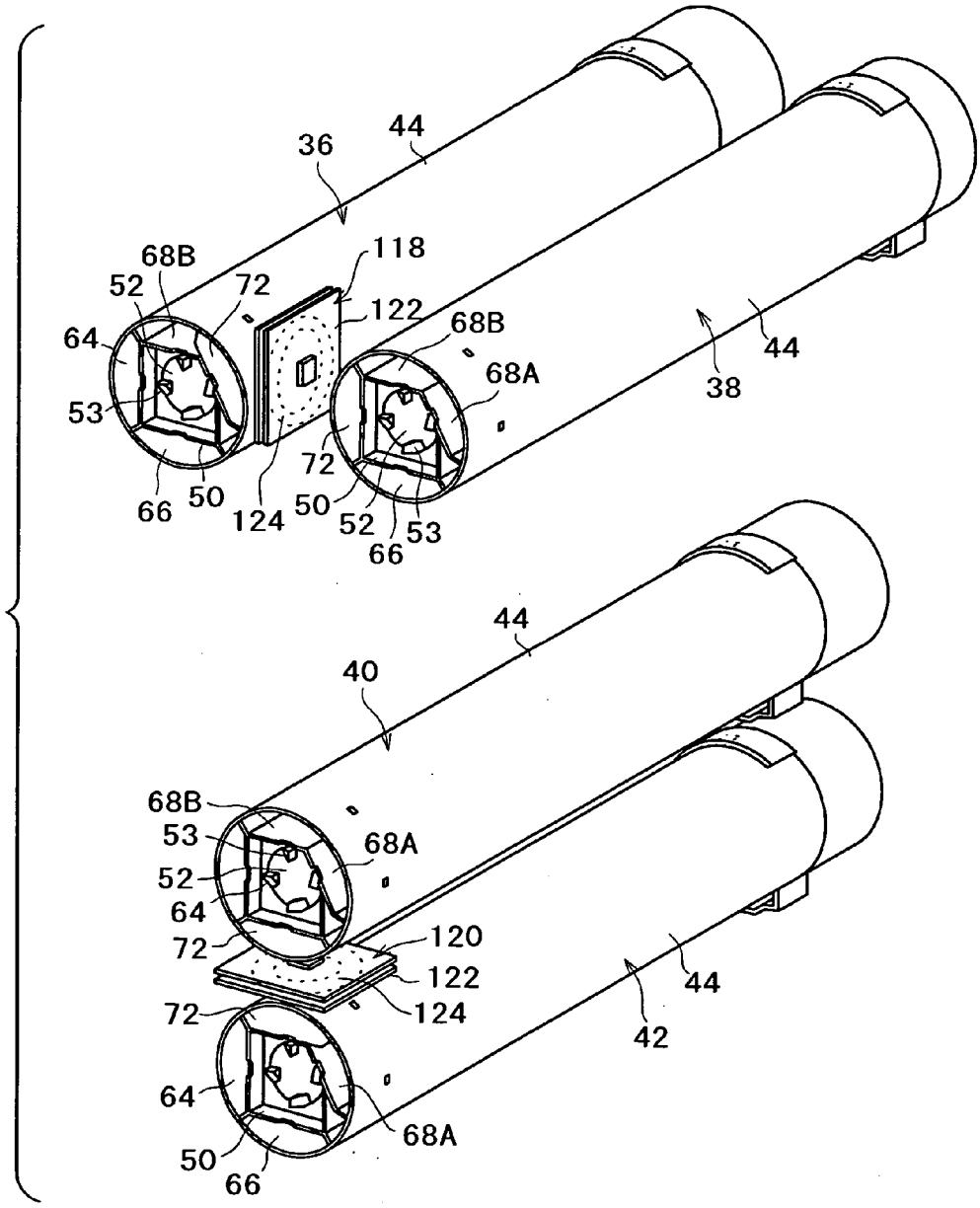
FIG. 11 is a perspective view showing a relative positional relationship between wireless communication tags of toner cartridges and body antenna units in the state in which the toner cartridges are loaded in the cartridge holder.

As shown in FIGS. 2 and 11, in the cartridge holder 34, plate-like antenna units 118 and 120 are respectively installed at the depth of the device between the loading/unloading parts 96 and 98 and at the depth of the device between the loading/unloading parts 100 and 102. The two antenna units 118 and 120 are respectively provided with casings 122 molded in the shape of a thin plate by resin, and within the casings 122, a body antenna 124 with a conductive wire such as a copper wire wound in coils is disposed. In the antenna units 118 and 120, the coil axis is parallel with the thickness direction of the casings 122 and the face and back faces (coil faces) along the direction square to the axis are parallel with the face direction of the casings 122. The antenna unit 118 disposed in the upper column of the cartridge holder 34 is supported so that the face direction is square to the width direction (the direction of the arrow W) of the device. The antenna unit 120 disposed between the middle and lower columns is supported so that the face direction is square to the height direction H (the direction of the arrow H) of the device.

As shown in FIG. 11, in the state in which the toner cartridges 36, 38, 40, are 42 are loaded in the cartridge holder 34, the upper antenna unit 118 is supported so that it is inserted in a gap formed between the toner cartridges 36 and 38 along the width direction of the device, and the lower antenna unit 120 is supported so that it is inserted in a gap formed between the toner cartridges 40 and 42 along the height direction H of the device. In the cartridge holder 34, the toner cartridge 36 is loaded in the second row farther from the developers 21, 23, 25, and 27. The toner cartridge 38 is loaded in the highest column of the first row nearer to the developers 21, 23, 25, and 27. The toner cartridge 40 and the toner cartridge 42 are respectively loaded in the middle column and the lowest column of the first row. Therefore, the antenna unit 118 is an antenna located between two toner cartridges adjacent to each other in the first and second rows, and the antenna unit 120 is an antenna located between the two remaining toner cartridges in the first row.

On the other hand, in the toner cartridge 36 loaded in the loading/unloading part 96 in the cartridge holder 34, the wireless communication tag 72 is fitted in the storage part 68A in the storage chamber 68, and in the toner cartridge 38 loaded in the loading/unloading part 98, the wireless communication tag 72 is fitted in the storage chamber 64. With this construction, the tag antenna 82 in the toner cartridge 36 is positioned so that its coil face is sufficiently close to one coil face of the body antenna 124 along the thickness direction thereof, and the tag antenna 82 in the toner cartridge 38 is made to face the body antennal 124 so that its coil face is sufficiently close to the other coil face of the body antenna 124 along the thickness direction thereof.

In the toner cartridge 40 loaded in the loading/unloading part 100 of the cartridge holder 34, a wireless communication tag 72 is fitted in the storage chamber 66. In the toner cartridge 42 loaded in the loading/unloading part 102, the wireless communication tag 72 is fitted in the storage part 68B in the storage chamber 68. With this construction, the tag antenna 82 in the toner cartridge 40 is positioned so that its coil face is sufficiently close to the coil face of the upper face of the body antenna 124, and the tag antenna 82 in the toner cartridge 42 is positioned so that its coil face is sufficiently close to the coil face of the lower face of the body antenna 124.

Radio wave sending and receiving between the tag antenna 82 and the body antenna 124 usually become more efficient for shorter distances between the antennas, and becomes more efficient for closer coaxial positional relationships between the tag antenna 82 and the body antenna 124. In the laser printer 10, the tag antennas 82 attached to the toner cartridges 38, 40, and 42 are supported coaxially with the body antenna 124, and under the condition in which the distance between the antennas is constant, radio wave sending and receiving with the body antenna 124 is possible with substantially maximum efficiency. Although the tag antenna 82 attached to the toner cartridge 36 is supported with a gradient of a constant angle (about 20 degrees) to the body antenna 124, since the distance from the body antenna 124 is sufficiently small, radio wave sending and receiving is possible with sufficiently high efficiency. In other words, if radio wave output used between the wireless communication tag 72 and a wireless communication device 130 of the printer (shown in FIG. 12) is made sufficiently small, with satisfactory wireless communications being maintained, interference from wireless communication tags 72 with which communication with the body antenna 124 is not set can be prevented without fail. The wireless communication device 130 and the antenna units 118 and 120 correspond to the communication control part in the image forming device of the present invention.

Instead of the toner cartridge 36 to be initially loaded, if the toner cartridge 38, 40, or 42 is loaded in the loading/unloading part 96, since the wireless communication tag 72 does not come to a position opposing the antenna unit 118, the body antenna 124 of the antenna unit 118 cannot receive radio waves from the wireless communication tag 72. This is also true for the loading/unloading parts 98, 100, and 102. In this way, if wrong toner cartridges are loaded in the loading/unloading parts 96, 98, 100, and 102, since radio waves from the wireless communication tags 72 loaded in the toner cartridges are not received in any of the antenna units 118 and 120, it can be determined whether correct toner cartridges have been loaded in the loading/unloading parts 96, 98, 100, and 102, based on whether radio waves from the wireless communication tags 72 have been received in the antenna units 118 and 120. When a wrong toner cartridge has been loaded, an alarm can be automatically issued.

In the laser printer 10, when the toner cartridges 36, 38, 40, and 42 are loaded in the corresponding loading/unloading parts 96, 98, 100, and 102 in the cartridge holder 34, the toner cartridges 36, 38, 40, and 42 are inserted toward the depth of the device along the depth direction and the tips of the toner cartridges 36, 38, 40, and 42 are hit against the drive plates 108. Thereby, the tips of the toner cartridges 36, 38, 40, and 42 are coupled to and supported by the drive plates 108, and the shutter engaging parts of the support brackets 106 engage with the shutter members 56 of the toner cartridges 36, 38, 40, and 42.

Next, by rotating the toner cartridge 36, 38, 40, and 42 clockwise by a specified angle by use of the handles 48, the toner cartridges 36, 38, 40, and 42 are loaded in the loading/unloading parts 96, 98, 100, and 102. At this time, the drive coupling plates disposed in the drive plates 108 engage with the driven coupling plates 52 of the toner cartridges 36, 38, 40, and 42, and the drive motors incorporated in the drive plates 108 are coupled to screw feeders within the toner cartridges 36, 38, 40, and 42 to transfer torques through the drive coupling plates and the driven coupling plates 52. According to the rotation of the toner cartridges 36, 38, 40, and 42 in the loading/unloading parts 96, 98, 100, and 102, the engaging shutters 107 of the support brackets 106 slide the shutter members 56 of the toner cartridges 36, 38, 40, and 42 from a closing position to an opening position and cause the toner supply ports 54 to be opened.

In the laser printer 10, during the operation of the developers 21, 23, 25, and 27, the drive motors incorporated in the drive plates 108 corresponding to the operating developers 21, 23, 25, and 27 are rotated. Thereby, the toner cartridges 36, 38, 40, and 42 discharge toners at a predetermined speed from the toner supply port 54 by dint of the screw feeders. The toners are supplied to the operating developers 21, 23, 25, and 27 through the toner feeding pipes 114. At this time, the amount of toners supplied to the developers 21, 23, 25, and 27 is set to be substantially equal to the amount of toners consumed for the development.

The toner cartridges 36, 38, 40, and 42 loaded in the cartridge holder 34 serve as containers for temporarily housing toners. In other words, the laser printer 10, during the operation of the developers 21, 23, 25, and 27, discharges toners from the toner cartridges 36, 38, 40, and 42, and supplies the toners to the developers 21, 23, 25, and 27. When the toners filled in the toner cartridges 36, 38, 40, and 42 have been exhausted, the corresponding toner cartridges 36, 38, 40, and 42 are replaced by new ones. At this time, since toners are tightly sealed within the toner cartridges 36, 38, 40, and 42, toner replenishing to the laser printer 10 can be easily performed, and device contamination due to scattered toners during toner replenishing can be effectively prevented.

(The configuration and Operation of a Wireless Communication System)

Next, a description is made of the configuration and operation of a wireless communication system in the laser printer according to the present embodiment configured as shown above.

Figure 12:
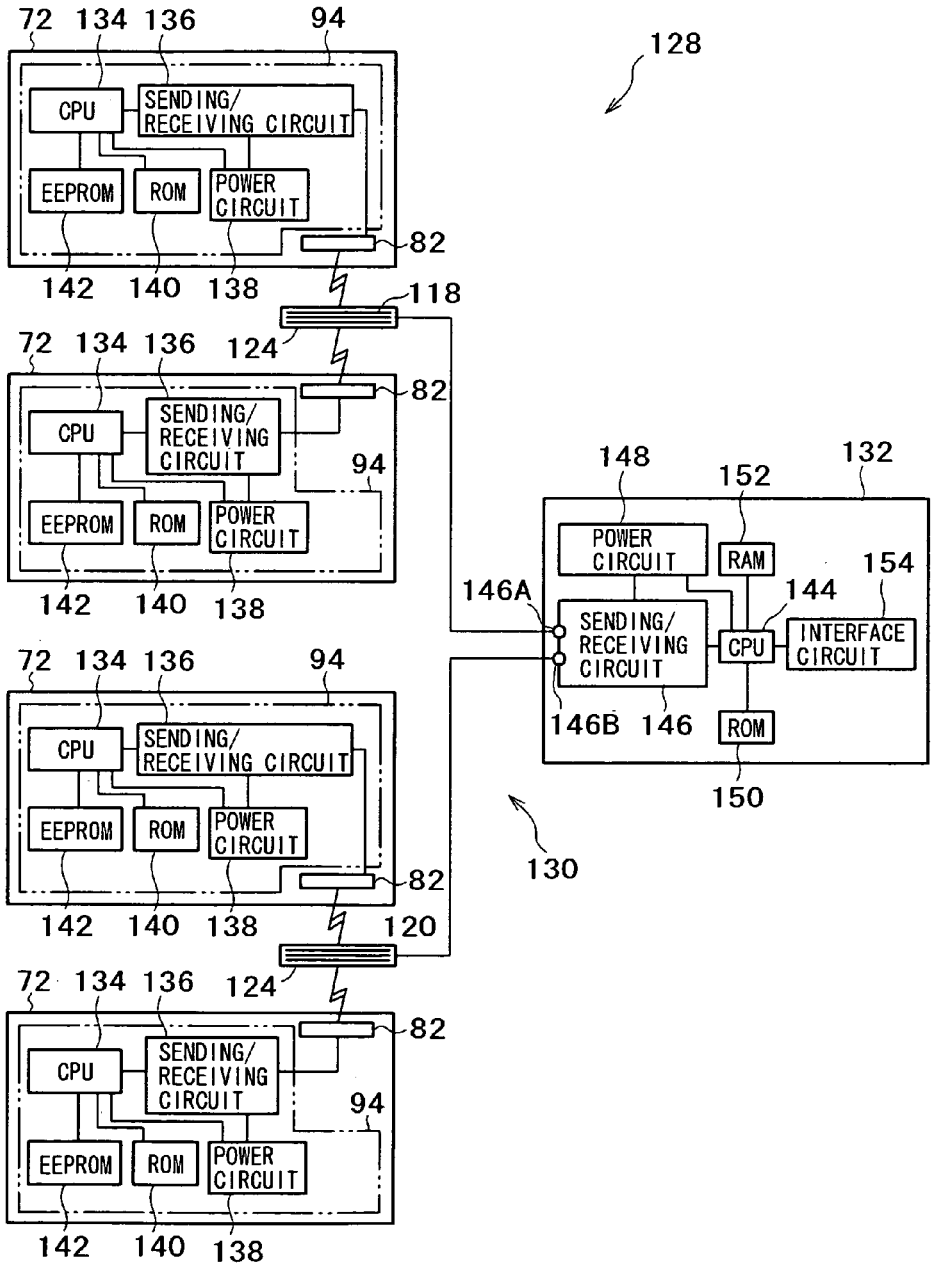
FIG. 12 is a block diagram showing the configuration of a wireless communication system included in the laser printer according to the first embodiment.

FIG. 12 is a block diagram showing the configuration of a wireless communication system according to an embodiment of the present invention. This wireless communication system 128 includes wireless communication tags 72 respectively attached to the toner cartridges 36, 38, 40, and 42, and the wireless communication device 130 disposed in the device. The wireless communication device 130 includes two antenna units 118 and 120 disposed in the cartridge holder 34, and body parts 132 connected to the body antennas 124 respectively incorporated in the antenna units 118 and 120.

As described previously, the wireless communication tag 72 attached to each of the toner cartridges 36, 38, 40, and 42 includes a coil-like tag antenna 82 and an IC chip 94 loaded on a circuit board 92. The IC chip 94 is, as shown in FIG. 12, formed as a single element in which a CPU 134, a sending and receiving circuit 136, a power circuit 138, a ROM 140, and an EEPROM 142 are integrated. The CPU 134 controls the whole wireless communication tag 72 in accordance with the control program stored in the ROM 140. The ROM 140 stores, in addition to the control program, information specific to the kinds of the toner cartridges 36, 38, 40, and 42, such as a multi-ID, a password, and a system ID. The multi-ID is basically predetermined data depending on the kinds of the toner cartridges 36, 38, 40, and 42, and the password and the system ID are respectively data for indicating the wireless communication tag 72 approved for information exchange with the wireless communication device 130.

On the other hand, the EEPROM 142 is a non-volatile information storage element not requiring power for maintaining stored information. Arbitrary information can be written to the EEPROM 142 by the CPU 134, and any information of written information can be read from the EEPROM 142. Specifically, to the EEPROM 142, for example, information as described below is written by the CPU 134, and the contents of written information are updated as required.

a. Process information such as the amount of exposure, the amount of charge, and development biases for the photosensitive drums 20, 22, 24, and 26 b. Information about the toner cartridges 36, 38, 40, and 42, such as lot number, production date, kind, retention period, recognition number, recycle count, upper limit on the recycle count, and replacement date of components of the cartridges c. Information about toners, such as lot number, production date, filling amount, kind, retention period, recycle count, upper limit on recycle count The sending/receiving circuit 136 in the wireless communication tag 72, when sending information, converts a parallel information signal sent from the CPU 134 into a serial information signal, and then outputs an electrical signal modulated by the information signal to the tag antenna 82. Thereby, from the tag antenna 82, a radio signal corresponding to the information signal from the CPU 134 is outputted (radiated). The sending/receiving circuit 136, when receiving information, demodulates an electrical signal obtained by a radio signal received by the tag antenna 82 to a serial information signal, and then converts the information signal to a parallel information signal and outputs it to the CPU 134.

The power circuit 138 in the wireless communication tag 72, during sending and receiving with the wireless communication device 130, separates an AC current of a specified frequency generated in the tag antenna 82 by electromagnetic induction from an information signal and converts the AC current into a DC current, and then supplies it to the CPU 134 and the sending/receiving circuit 136. Thereby, the CPU 134 and the sending/receiving circuit 136 are supplied with power required for sending and receiving to and from the wireless communication device 130, eliminating the need to provide the wireless communication tag 72 with power such as a battery.

As shown in FIG. 12, the main body of the wireless communication device 130 is provided with a CPU 144, a sending/receiving circuit 146, a power circuit 148, a ROM 150, a RAM 152, and an interface circuit 154. The sending/receiving circuit 146 has two input-output terminals 146A and 146B for the antennas, with one input-output terminal 146A connected to the body antenna 124 of the antenna unit 118, and the other input-output terminal 146B connected to the body antenna 124 of the antenna unit 120. The sending/receiving circuit 146, when sending and receiving information to and from the wireless communication tags 72, turns on only one of the input-output terminals 146A and 146B and turns off the other according to information input-output destinations.

The CPU 144 controls the whole wireless communication device 130 according to the control program stored in the ROM 150. The ROM 150 stores, in addition to the control program, multi-IDs, passwords, and system IDs for all the toner cartridges 36, 38, 40, and 42. The CPU 144 compares multi-IDs and passwords inputted from the wireless communication tags 72 with multi-IDs and passwords stored in the ROM 150, thereby identifying the kinds of the toner cartridges 36, 38, 40, and 42 provided with the wireless communication tags 72 during radio communication, and confirming wireless communication tags 72 approved for information exchange with the wireless communication device 130.

The CPU 144 temporarily stores process information such as the amount of exposure, the amount of charge, and development biases for the photosensitive drums 20, 22, 24, and 26 for each of the toner cartridges 36, 38, 40, and 42 that is sent from a central control part (not shown) of the laser printer 10 through the interface circuit 154, as well as writing information such as toner consumption amounts calculated based on the process information, in the RAM 152, and then reads transmission information from the RAM 152 at a proper timing and sends it to the wireless communication tags 72. Thereby, the CPUs 134 of the wireless communication tags 72 write the writing information received from the wireless communication device 130 to the EEPROMs 142 and record the amounts of residual toners obtained by subtracting the amounts of toners consumed from the filling amounts of the toners in the EEPROMs 142.

The sending/receiving circuit 146 in the main body, when sending information, converts a parallel information signal sent from the CPU 144 into a serial information signal, and then outputs an electrical signal modulated by the information signal to either of the two body antennas 124. Thereby, from the body antenna 124, a radio signal corresponding to the information signal from the CPU 144 is outputted (radiated). The sending/receiving circuit 146, when receiving information, demodulates an electrical signal obtained by a radio wave received by the body antennas 124 to a serial information signal, and then converts the information signal to a parallel information signal and outputs it to the CPU 144.

The power circuit 148 in the main body, during communication with the wireless communication tag 72, supplies an AC current of a specified frequency to the body antenna 124. Thereby, electromagnetic induction occurs in the tag antenna 82 facing the body antenna 124, and as described previously, power is supplied to the wireless communication tag 72. For the frequency of the AC current supplied to the body antenna 124 by the power circuit 148, during sending, the same band as that of the frequency of an electrical signal used for information transmission by the sending/receiving circuits 136 and 146 is selected; during receiving, a different band (e.g., high frequency) from it is selected.

Upon determining that the toners have been exhausted from the toner cartridges 36, 38, 40, and 42, the CPU 144 of the main body sends a count-up signal to a wireless communication tag 72 attached to the corresponding toner cartridge 36, 38, 40, or 42. The CPU 134 of the wireless communication tag 72 receiving the count-up signal adds 1 to a recycle count on the toner cartridges 36, 38, 40, and 42 and a recycle count on the toners that are written to the EEPROM 142.

Figure 13:
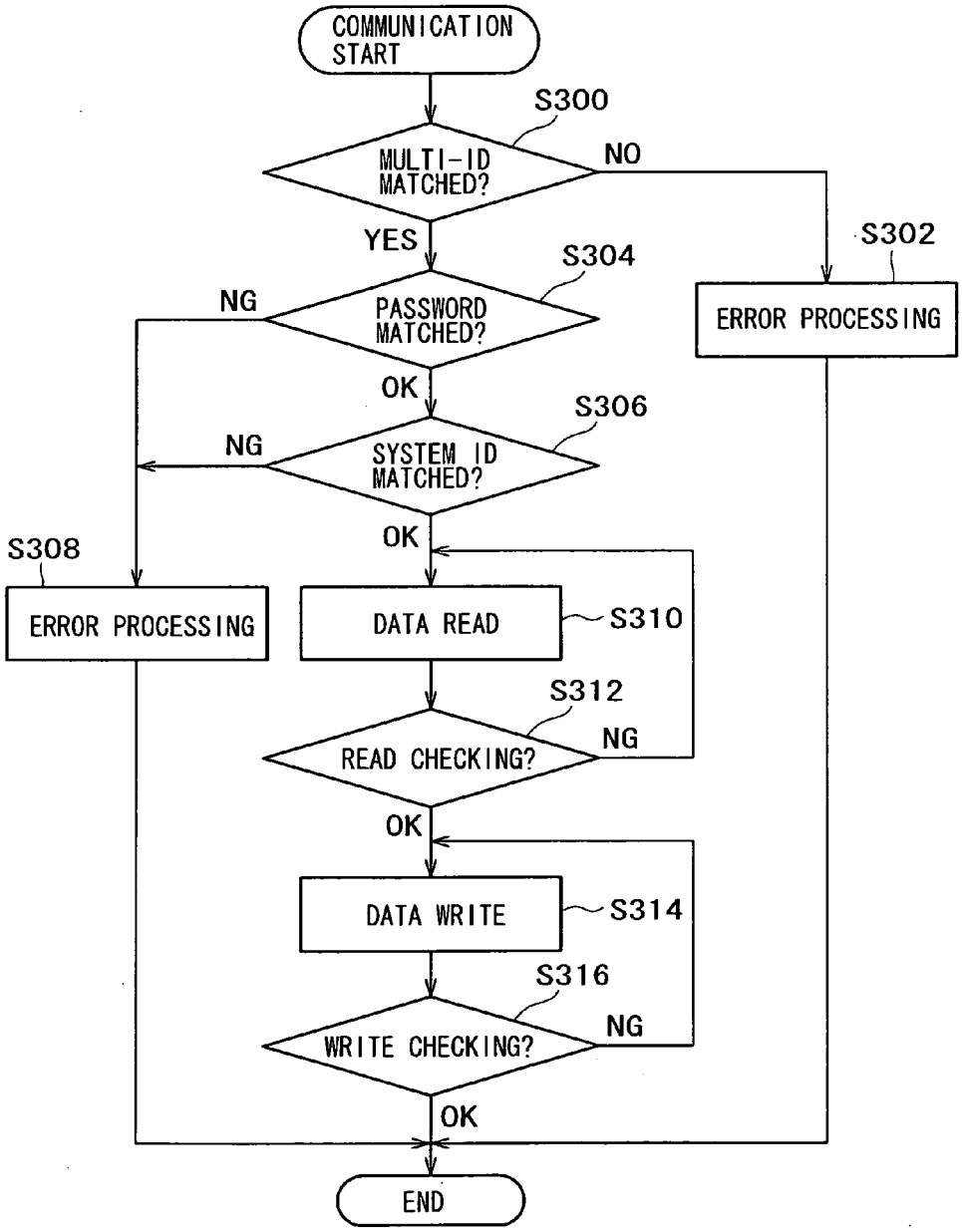
FIG. 13 is a flowchart showing the operation of the wireless communication system shown in FIG. 12.

FIG. 13 shows a series of operations of communication start processing in the wireless communication system 128 according to the present embodiment. In the laser printer 10, if power-on operation, replacement of the toner cartridges 36, 38, 40, and 42, and reset operation after the occurrence of abnormality such as jam have been performed, communication start processing of the wireless communication system 128 as shown in FIG. 13 is performed by the CPU 144 of the wireless communication device 130.

In the wireless communication system 128, the parties with which the wireless communication device 130 communicates are exactly the wireless communication tags 72 attached to the toner cartridges 36, 38, 40, and 42. However, in the description of a flowchart of FIG. 8 below, if wireless communication parties do not need to be exactly differentiated, for simplicity of description, the communication parties of the wireless communication device 130 are simply referred to as toner cartridges 36, 38, 40, and 42.

In the communication start processing, in step 300, it is determined whether a multi-ID (M) on the side of the wireless communication device 130 and a multi-ID (M) on the side of the toner cartridge 36 match. In step 300, if a multi-ID (M) on the side of the wireless communication device 130 and the multi-ID (M) on the side of the toner cartridge 36 match, determining that a proper toner cartridge 36 is loaded in the loading/unloading part 96 of the cartridge holder 34, the system instructs the routine to proceed to step 304, and the wireless communication device 130 starts communication with the toner cartridge 36. If a multi-ID (M) on the side of the wireless communication device 130 and the multi-ID (M) on the side of the toner cartridge 36 do not match, the system instructs the routine to proceed to step 302, where specified error processing is performed, determining that no toner cartridge is loaded in the loading/unloading part 96 of the cartridge holder 34, or an improper toner cartridge is loaded in the loading/unloading part 96.

In steps 304 to 306, between the wireless communication device 130 and the toner cartridge 36, password matching and system ID matching are sequentially performed. If it is determined that either of the password and the system ID on the side of the toner cartridge 36 is not proper, determining that the toner cartridge loaded in the loading/unloading part 96 is improper, the system instructs the routine to proceed to step 308, where specified error processing is performed. If it is determined that both of the password and the system ID on the side of the toner cartridge 36 are proper, the system instructs the routine to proceed to 310, the CPU 144 of the wireless communication device 130 controls the wireless communication tag 72 in the toner cartridge 36 and reads, from the EEPROM 142, process information such as the amount of exposure, the amount of charge, and development biases for the photosensitive drums 20, 22, 24, and 26, and information about toners, such as a filling amount, kind, and retention period.

In step 312, the CPU 144 in the wireless communication device 130 performs a read check with the CPU 134 of the toner cartridge 36 to determine whether or not the information read from the EEPROM 142 matches information written to the EEPROM 142. If they match, the system instructs the routine to proceed to step 314, and if they do not match, the system instructs the routine to return to step 310 to repeat information reading from the EEPROM 142 until the information read from the EEPROM 142 matches information written to the EEPROM 142.

In step 314, the CPU 144 of the wireless communication device 130 sends initial information such as an identification number specific to the laser printer 10, an identification number specific to the user, and the use opening time of the toner cartridge 36 to the wireless communication tag 72 in the toner cartridge 36, and writes the initial information to the EEPROM 142 of the wireless communication tag 72. In step 316, the CPU 144 in the wireless communication device 130 performs a read check with the CPU 134 in the toner cartridge 36 to determine whether the sent initial information has been correctly written to the EEPROM 142. If the sent initial information and the written initial information match, the system terminates communication with the toner cartridge 36. If both the initial information does not match, the system instructs the routine to return to step 314 to repeat information writing to the EEPROM 142 until the initial information sent to the wireless communication tag 72 matches information written to the EEPROM 142.

After the termination of the communication start processing for the toner cartridge 36 housing the aforementioned M toner, the wireless communication system 128 sequentially performs operations basically identical with a series of operations of the communication start processing shown in FIG. 8 for the toner cartridges 38, 40, and 42 housing the other Y, K, and C toners as well. After the termination of the communication start processing between the wireless communication device 130 and all the toner cartridges 36, 38, 40, and 42, the central control part of the laser printer 10 unlocks interlock so that an image formation operation can be started.

Every time an image is formed or every predetermined times an image is formed, the central control part outputs process information and information about toner consumption amounts corresponding to the toner cartridges 36, 38, 40, and 42 to the CPU 144 through the interface circuit 154 in the wireless communication device 130. The CPU 144 sends the information from the central control part to the wireless communication tag 72 of the corresponding toner cartridge 36, 38, 40, or 42, and at the same time, writes the information from the central control part to the EEPROM 142 of the wireless communication tag 72.

(Operation of the Embodiment)

A description is made of the operation of the laser printer 10 according to the present embodiment constructed as described above.

In the wireless communication system 128 of the laser printer 10 according to the present embodiment, the tag antennas 82 respectively disposed in the toner cartridges 36, 38, 40, and 42 are supported by the toner cartridges 36, 38, 40, and 42 so that their coil axis TC is substantially square to the direction of insertion to and removal from the loading/unloading parts 96, 98, 100, and 102. Since this construction eliminates the need to dispose the tag antennas 82 so as to cover the ends of the toner cartridges 36, 38, 40, and 42, even if the cap parts 46, the driven coupling plates 52, and the like are disposed in the ends of the toner cartridges 36, 38, 40, and 42, the wireless communication tags 72 can be easily attached to the toner cartridges 36, 38, 40, and 42 so as not to interfere with these parts.

In the wireless communication system 128, the body antennas 124 are disposed in the cartridge holder 34 so that their coil axis BC is substantially square to the direction of insertion to and removal from the loading/unloading parts 96, 98, 100, and 102 of the toner cartridges 36, 38, 40, and 42, and the coil face along a direction square to the coil axis BC faces the coil face of the tag antennas 82. Since this construction eliminates the need to dispose the body antennas 124 in portions facing the ends of the toner cartridges 36, 38, 40, and 42 in the device body, even if parts such as the drive coupling plates are disposed in portions facing the ends of the toner cartridges 36, 38, 40, and 42 in the device body, the body antennas 124 can be easily loaded in the device body so as not to interfere with these parts.

Specifically, in the wireless communication system 128, the two body antennas 124 are respectively disposed in the gap occurring between the toner cartridges 36 and 38, and the gap occurring between the toner cartridges 40 and 42. Therefore, the body antennas 124 can be disposed in spaces (dead spaces) that have been little used effectively in conventional laser printers, and the body antennas 124 can be easily made to face the tag antennas 82 while being brought sufficiently near to the tag antennas 82. As a result, the body antennas 124 can be efficiently disposed in the narrow spaces within the device body, and power supply and radio communication by dint of electromagnetic induction can be performed without fail between the wireless communication device 130 and the wireless communication tags 72 attached to the toner cartridges 36, 38, 40, and 42.

In the wireless communication system 128, since the surface and the back of the body antennas 124 respectively face different tag antennas 82, even if the body antennas 124 are miniaturized to be nearly identical in size with the tag antennas 82, electromagnetic induction and radio sending and receiving can be performed without fail between one body antenna 124 and two tag antennas 82.

Since toner cartridges are loaded in two or more rows in the toner cartridge loading part of the image forming device along a horizontal direction or vertical direction, the size of the toner cartridge loading part in the height and width directions can be substantially reduced. Therefore, the height and width of the image forming device itself can be reduced, and space inside the image forming device can be effectively utilized.

The toner cartridge insertion face is the face along which toner cartridges are inserted in the toner cartridge loading part. In the toner cartridge loading part in which toner cartridges are horizontally loaded, the toner cartridge insertion face is normally a vertical plane, and in the toner cartridge loading part in which toner cartridges are vertically loaded, the toner cartridge insertion face is normally a horizontal plane.

The length direction is a length direction with respect to the user facing the toner cartridge insertion face; it is not limited to the vertical direction. Likewise, the lateral direction is a lateral direction with respect to the user facing the toner cartridge insertion face; it is not limited to the horizontal direction. However, in the toner cartridge loading part in which toner cartridges are horizontally loaded, the length direction is a vertical direction and the lateral direction is a horizontal direction.

Examples of the image forming device include a facsimile, a printer, and the like, in addition to a copying machine.

As has been described above, according to the present invention, a compact image forming device that can effectively utilize free spaces is provided.

The entire disclosure of Japanese Patent Application No. 2003-274327 filed on Jul. 14, 2003 including specification, claims, drawings and abstract is incorporated herein by reference in its entirety.

What is claimed is:

1. An image forming device that forms images by electrophotographic processes and includes a toner cartridge loading part in which three or more toner cartridges for housing toners used to form the images are loaded, wherein the toner cartridges are stationarily held in two or more rows in a length direction or lateral direction in a toner cartridge insertion face of the toner cartridge loading part, and wherein at least two of the two or more rows include an unequal number of toner cartridges.

2. The image forming device according to claim 1, wherein the image forming device is a full-color image forming device which forms an image by use of four colors of yellow, magenta, cyan, and black, and in which four toner cartridges housing the toners of the colors are loaded, and in the toner cartridge loading part in which the toner cartridges are loaded, the toner cartridges are substantially horizontally loaded and arranged in two rows along a substantially vertical direction, with three toner cartridges loaded in one row and one in another row.

3. The image forming device according to claim 2, wherein the toner cartridge loaded in the other row in the toner cartridge loading part is loaded at a height substantially identical with a toner cartridge in the highest column of the one row.

4. The image forming device according to claim 2, wherein the toner cartridge loaded in the other row in the toner cartridge loading part is loaded at a height substantially identical with a toner cartridge in the lowest column of the one row.

5. The image forming device according to claim 4, wherein, in the toner cartridge loading part, two toner cartridges loaded adjacent to each other in a horizontal direction are loaded so that one is loaded projectingly along an axial direction compared to the other.

6. The image forming device according to claim 5, wherein, in a state in which the toner cartridges are loaded in the toner cartridge loading part, the toner cartridges are formed so that operation end faces thereof at a user operation side are on a substantially identical vertical plane.

7. The image forming device according to claim 6, wherein the toner cartridges comprise a substantially cylindrical closed-end cartridge body that is open in an end of the operation side, and a cap part that covers an opening of the operation side of the cartridge body to form the end face of the operation side, and a length of the cap part thereof in the axial direction is formed so that the operation end faces thereof are on the substantially identical vertical plane in the state in which the toner cartridges are loaded in the toner cartridge loading part.

8. The image forming device according to claim 7, wherein, in the other row of the toner cartridge loading part, a toner cartridge that is larger in toner filling capacity than the three toner cartridges loaded in the one row is loaded.

9. The image forming device according to claim 8, wherein the toner cartridge loaded in the other row is a black toner cartridge housing a black toner.

10. The image forming device according to claim 9, wherein, in the state in which toner cartridges are loaded in the toner cartridge loading part, an electronic circuit device is disposed in a space surrounded by the three toner cartridges loaded in the one row in the toner cartridge loading part and the one toner cartridge loaded in the other row.

11. The image forming device according to claim 1, wherein, in the toner cartridge loading part in which the toner cartridges are loaded, the toner cartridges are arranged in two rows along the same direction, with three toner cartridges loaded in one row and one in another row.

12. The image forming device according to claim 1, wherein the image forming device is a full-color image forming device which forms an image by use of four colors of yellow, magenta, cyan, and black, and in which four toner cartridges housing the toners of the colors are loaded, and in the toner cartridge loading part in which the toner cartridges are loaded, the toner cartridges are substantially horizontally loaded and arranged in two rows along a substantially horizontal direction, with three toner cartridges loaded in one row and one in another row.

13. The image forming device according to claim 12, the toner cartridge loaded in the other row of the toner cartridge loading part is at an upper or lower position of a toner cartridge at a right end or a left end in the one row.

14. The image forming device according to claim 13, wherein, in the state in which toner cartridges are loaded in the toner cartridge loading part, an electronic circuit device is disposed in a space surrounded by the three toner cartridges loaded in the one row in the toner cartridge loading part and the one toner cartridge loaded in the other row.

15. The image forming device according to claim 1, wherein the image forming device is a full-color image forming device which forms an image by use of four colors of yellow, magenta, cyan, and black, and in which four toner cartridges housing the toners of the colors are loaded, and in the toner cartridge loading part, the toner cartridges are arranged in two rows along the vertical direction or horizontal direction, with three toner cartridges loaded in one row and one in another row, the toner cartridge in the other row being adjacent to a toner cartridge at an end of the one row, the toner cartridge loading part is loaded with toner cartridges including wireless communication tags for sending and receiving radio signals, and includes a communication control part that sends and receives radio signals to and from the wireless communication tags included in the toner cartridges, and the communication control part includes two antennas, and in a state in which the toner cartridges are loaded, one of the antennas is disposed between two toner cartridges adjacent to each other in the one row and the other row, the other of the antennas is disposed between residual two toner cartridges in the one row.

16. The image forming device according to claim 1 comprising, a toner transport unit that transports toners from the toner cartridge loading part to developers in the image forming device, wherein the toner transport unit comprises a flexible tube and an auger, disposed within the flexible tube, that has a spiral blade rotating around an axis.

17. The image forming device according to claim 16, wherein the flexible tube is transparent or semitransparent.

18. The image forming device according to claim 16, wherein the blade of the auger is formed by winding a plate in coils.

19. The image forming device according to claim 16, wherein the flexible tube is disposed to be within ±20 degrees to a horizontal plane.

20. The image forming device according to claim 16, wherein the outside diameter of the auger is smaller than an inside diameter of the flexible tube, and a difference between the inside diameter of the flexible tube and the outside diameter of the auger is a range of 1 to 2 mm.

* * * * *